US005603159A

United States Patent [19]

Tsubakida et al.

[11] Patent Number: 5,603,159

[45] Date of Patent: Feb. 18, 1997

[54] METHOD OF PRODUCING HEAT EXCHANGERS

[75] Inventors: Toshio Tsubakida; Yoshihisa Eto; Takashi Sugita; Shoji Kuwabara, all of Konan, Japan

[73] Assignee: Zexel Corporation, Tokyo, Japan

[21] Appl. No.: 534,559

[22] Filed: Sep. 27, 1995

[30] Foreign Application Priority Data

Sep. 29, 1994 [JP] Japan ..... 6-259531
Jan. 17, 1995 [JP] Japan ..... 7-022271

[51] Int. Cl.[6] ..... B23P 15/26

[52] U.S. Cl. ..... 29/890.039; 29/890.053

[58] Field of Search ..... 29/890.053, 890.039, 29/890.03, 428

[56] References Cited

U.S. PATENT DOCUMENTS 3,341,925 9/1967 Gerstung ..... 29/890.039
3,451,114 6/1969 Werneke ..... 29/890.039
3,757,856 9/1973 Kun ..... 29/890.039
3,845,814 11/1974 Kun ..... 29/890.039
4,896,411 1/1990 Dempsey ..... 29/890.039
5,180,004 1/1993 Nguyen .
5,211,222 5/1993 Shinmura .

FOREIGN PATENT DOCUMENTS 60-015031 1/1985 Japan .
62-286632 12/1987 Japan .

*Primary Examiner*—Irene Cuda
*Attorney, Agent, or Firm*—Wenderoth, Lind & Ponack

[57] ABSTRACT

A method of producing heat exchangers that two heat exchangers are produced simultaneously in one assembly line, being provided with a tube element unit having a pair of intake/outlet portions on the both ends thereof, a pair of medium passages communicating between a pair of the intake/outlet portions and a cutting portion in a middle portion thereof, and a pair of tanks arranged on both sides of the tube element units, the tube element units being maintained by the tanks provisionally, after brazing, two heat exchangers being separated by cutting the cutting portion.

15 Claims, 16 Drawing Sheets

METHOD OF PRODUCING HEAT EXCHANGERS

BACKGROUND OF THE INVENTION

1. Field of the Invention

The present invention relates to a laminated heat exchanger and a method for producing it used as a heater core, for instance, in an air conditioner for an automobile.

2. Description of the Related Arts

As a method for producing two or more heat exchangers at a time on one assembly line, for example, what is shown in a specification and FIG. 1 through FIG. 3 of Japanese Patent Unexamined Publication No. 62-286632 is well known.

The method for producing the heat exchanger shown in the publication shows the following:

at a first process, a flat plate is formed;

at a second process, a bulging portion for forming a passage and an intake opening and an outlet opening communicated with the bulging portion for forming the passage are formed a couple symmetrically in the longitudinal direction of the belt-like plate by a press;

at a third process, a passage unit is constituted by bonding flush two belt-like plates, the passage unit having a pair of fluid passages into which medium flows;

at a fourth process, a plurality of passage units are laminated by arranging a fin therebetween respectively, thus the intake openings being communicated, the intake openings being communicated; and at a fifth process, which is the last one, between a pair of fluid passages of the laminated passage units is cut to separate to two heat exchangers.

However, in the above mentioned method of producing heat exchanger, since the passage units is only laminated but not fixed, it is necessary to maintain the passage units provisionally by holders until brazing them.

Thus, because a longitudinal dimension of the passage unit is twice or more in comparison with what used in the case that a single heat exchanger is formed, it is necessary for the provisional maintenance by the holders to be done in two portions as both side ends in the longitudinal direction of the heat exchanger, or in three portions further added a central portion thereof, there being inconvenience of that the provisional maintenance work of the heat exchangers takes a great deal of time and labor.

Further more, both sides of every passage unit are claded with a solder member for brazing, the solder member melts in a furnace and a pair of the heat exchangers are formed.

However, in the aforementioned, as there is a problem that the holders and the passage units are connected by solder claded on the passage units, thus, it is difficult to separate the holders from the heat exchangers, a side plate and other parts being necessary to prevent connecting between the holders and the passage units, there being inconvenience like them.

SUMMARY OF THE INVENTION

Accordingly, the object of the present invention is to provide a method for producing heat exchangers and their heat exchangers without using holders to maintain an assemble provisionally, which is comprised of tube elements and so on, and it is easy to separate the assemble, in the case that two heat exchangers are made simultaneously on an assembly line, for the time till the heat exchangers is soldered after they are assembled provisionally.

Therefore, the method of producing heat exchangers comprising a tank having an end plate formed a plurality of connecting holes disposed in parallel along the laminating direction, a pair of intake/outlet portions installed into the connecting holes, tube elements having U-shaped heat exchanging medium passage connecting between the intake/outlet portions, and fins inserted between the tube elements, comprising steps of: (a) forming a form plate which comprises a pair of bulging portions for intake/outlet formation being intake/outlet portions formed on the both sides of longitudinal direction of a long and narrow plate, both projections extended from between the bulging portions for intake/outlet formation toward the middle of the plate, bulging portions for passage formation formed around each of the projections, and a outting unit formed in the middle of the longitudinal direction of the long and narrow plate; (b) bonding flush two of the formed plates and constituting a tube element unit comprising a pair of tube elements which are joined on the cutting unit having a cutting portion; (c) assembling provisionally by that the intake/outlet portions formed on the both ends of the tube element unit are formed being inserted into connecting holes of the tanks disposed on the both sides of the tube element unit by putting corrugated fins between the tube elements to form an assembly comprising two heat exchangers; (d) brazing the assembly in a furnace; and (e) cutting the cutting portion to separate the assembly, producing two heat exchangers.

According to the method of producing the heat exchangers in this invention, since the intake/outlet portions formed on the both ends of longitudinal direction of the tube element unit inserting the connecting holes of each tank and the laminated tube elements are held by the tanks disposed on the both sides of tube element unit, the assembly may be in the condition of provisional maintenance by assembling the tube element units to the tanks provisionally. Thus, the holders become useless, it is easy to treat the assembly.

Further, a middle portion of the form plate for the heat exchanger has a pair of fin contacting portions side by side in the middle portion, one fin contacting portion extending from one side of the middle portion and bent up in the bulging direction of the form plate and perpendicular against the form plate, another fin contacting portion next to one fin contacting portion extending from another side of the middle portion in the bulging direction of the form plate and perpendicular against the form plate.

According to the form plate, since the fin contacting portions are formed by being bent up in the direction which is the same as the bulging direction of the form plate, the form plate may not be pulled to the middle portion and a connecting portion joining two portions of the form plate may not deform in the process of pressing the form plate.

Furthermore, it is to be desired that length of the bending fin contacting portion is more than half of distance between the cutting portions of the tube element units facing each other in the laminated direction.

According to the form plate, since the fin contacting portions are more than half of distance between the cutting portion of the tube element units facing each other in the laminated direction, the fins may not pass through clearance between the fin contacting portions and the fins may be held firmly.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENT

The following is an explanation of the embodiment according to the present invention in reference to the drawings.

Figure 1:
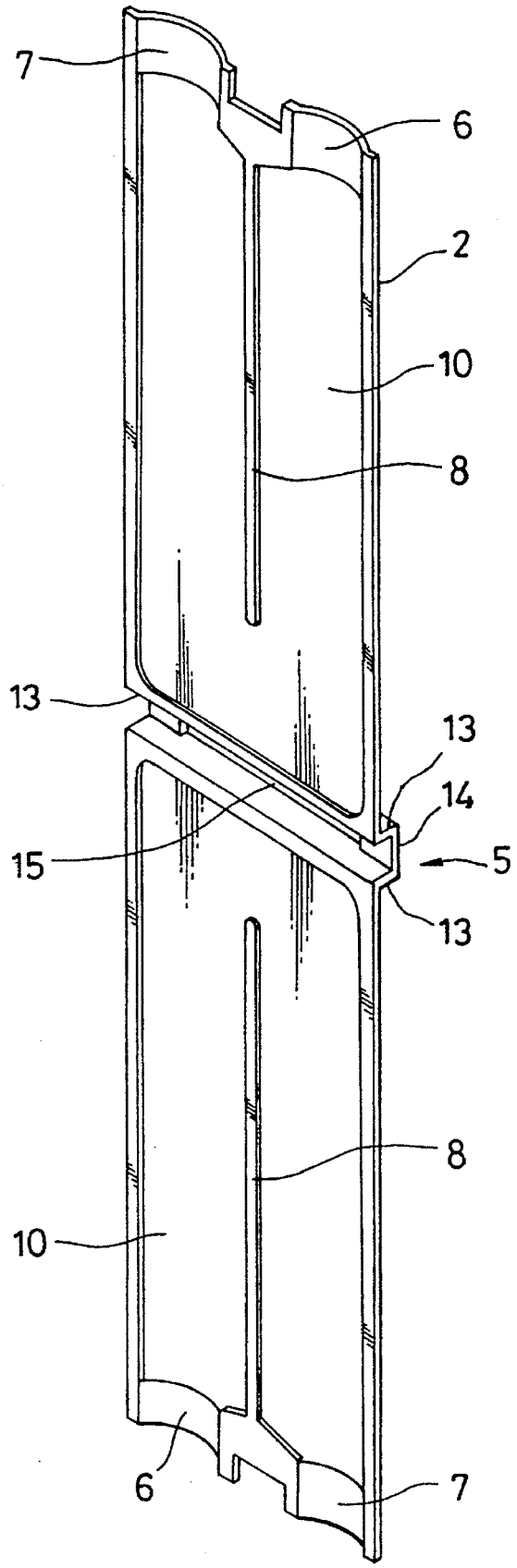
FIG. 1 is a perspective view illustrating a structure of a form plate for a heat exchanger in a first embodiment of this invention.

FIG. 1 shows a first embodiment of a form plate 2 used in method of producing a heat exchanger of this invention.

The form plate 2 is a long, narrow and rectangular plate that solder is claded on both sides thereof, which is made of aluminum alloy which aluminum is a main ingredient, as shown in FIG. 1, wherein a pair of intake/outlet portions for intake/outlet formation 6 and 7, which become intake/outlet of heat exchanging medium, in both sides of longitudinal direction of the form plate are formed by distending, for instance, by press processing.

A specific length of projection 8 extends from between a pair of bulging portions for intake/outlet formation 6 and 7 formed in both sides of longitudinal direction of the form plate 2 against the side of a middle portion 5, and bulging portions for passage formation 10 communicating the bulging portions for intake/outlet formation 6 and 7 are formed around the projection 8 by press processing.

A cutting unit 5 in the middle of the form plate 2 is pressed and expanded in the bulging direction of the form plate, comprising fin contacting portions 13 and a cutting portion 14 connecting between the fin contacting portions 13. The form elate 2 is symmetrical with respect to the cutting unit. The fin contacting portion 13 is connecting between the ends of tube elements 20 to hold the ends of corrugated fins 3 when tube elements 20 is laminated. The cutting portion 14 has a rectangular opening 15 in the middle thereof to be easy to cut.

Figure 2:
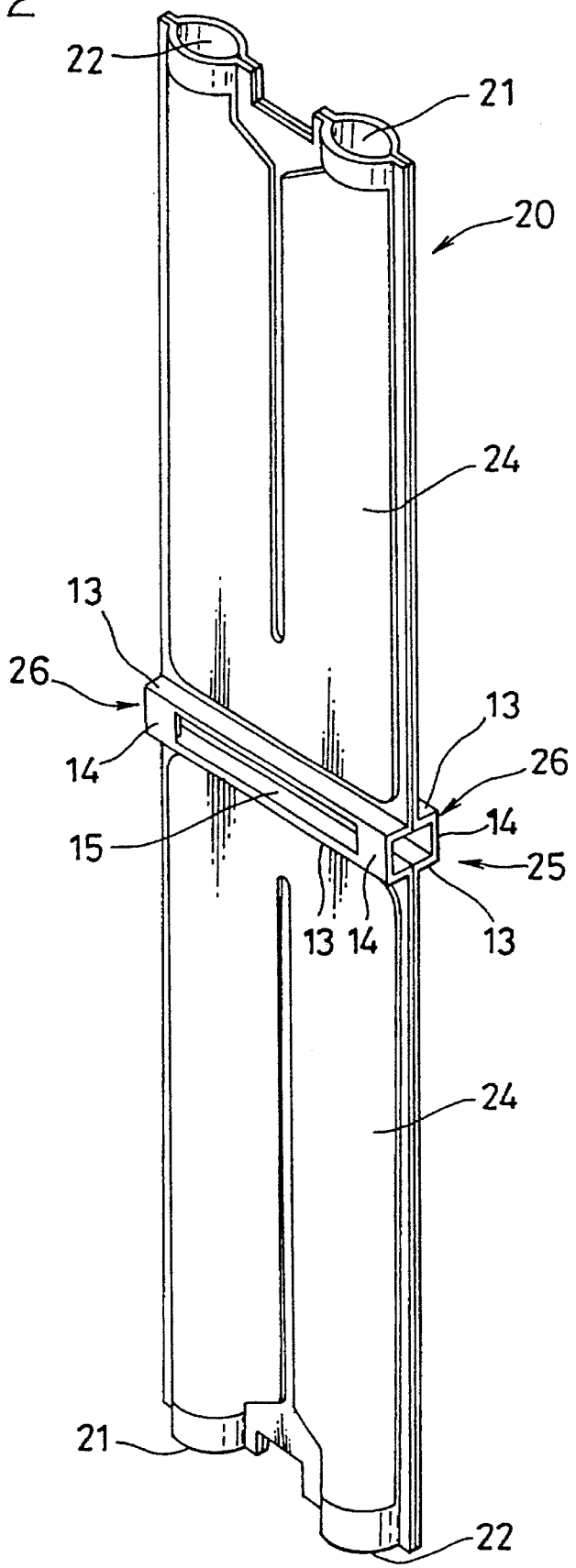
FIG. 2 is a perspective view of a tube element unit comprising a pair of tube elements constituted by bonding flush two of the form plates illustrated in FIG. 1.

The tube element unit 20A, as shown in FIG. 2, constituted by bonding flush two of the form plates 2, a pair of intake/outlet openings 21 and 22 being made of the bulging portions for intake/outlet formation 6 and 7 on both sides thereof, approximately U-shaped heat exchanging medium passages 24 being made of the bulging portions for passage formation 10 on the inside, thus, two tube elements 20 are formed therein and symmetrical with respect to the cutting unit 5. The intake/outlet openings 21 and 22 communicate each other through the heat exchanging medium passage 24. A cutting unit 26 is formed in the middle portion 25 of the tube element unit 20A and constituted by the fin contacting portion 13 and the cutting portion 14.

Figure 3:
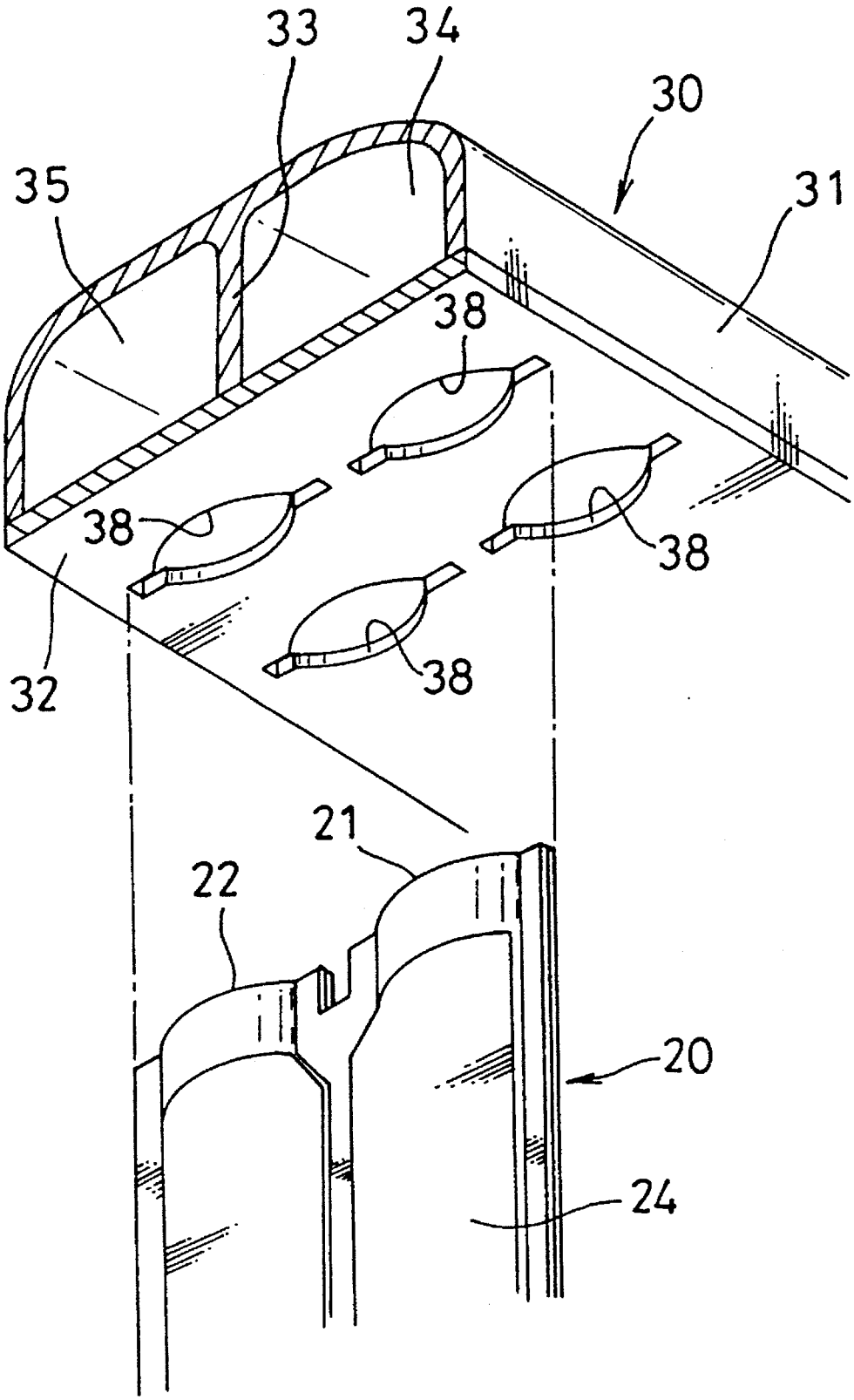
FIG. 3 is a part perspective view illustrating the state that the tube elements shown in FIG. 2 are inserted into connecting holes of a tank.
Figure 4:
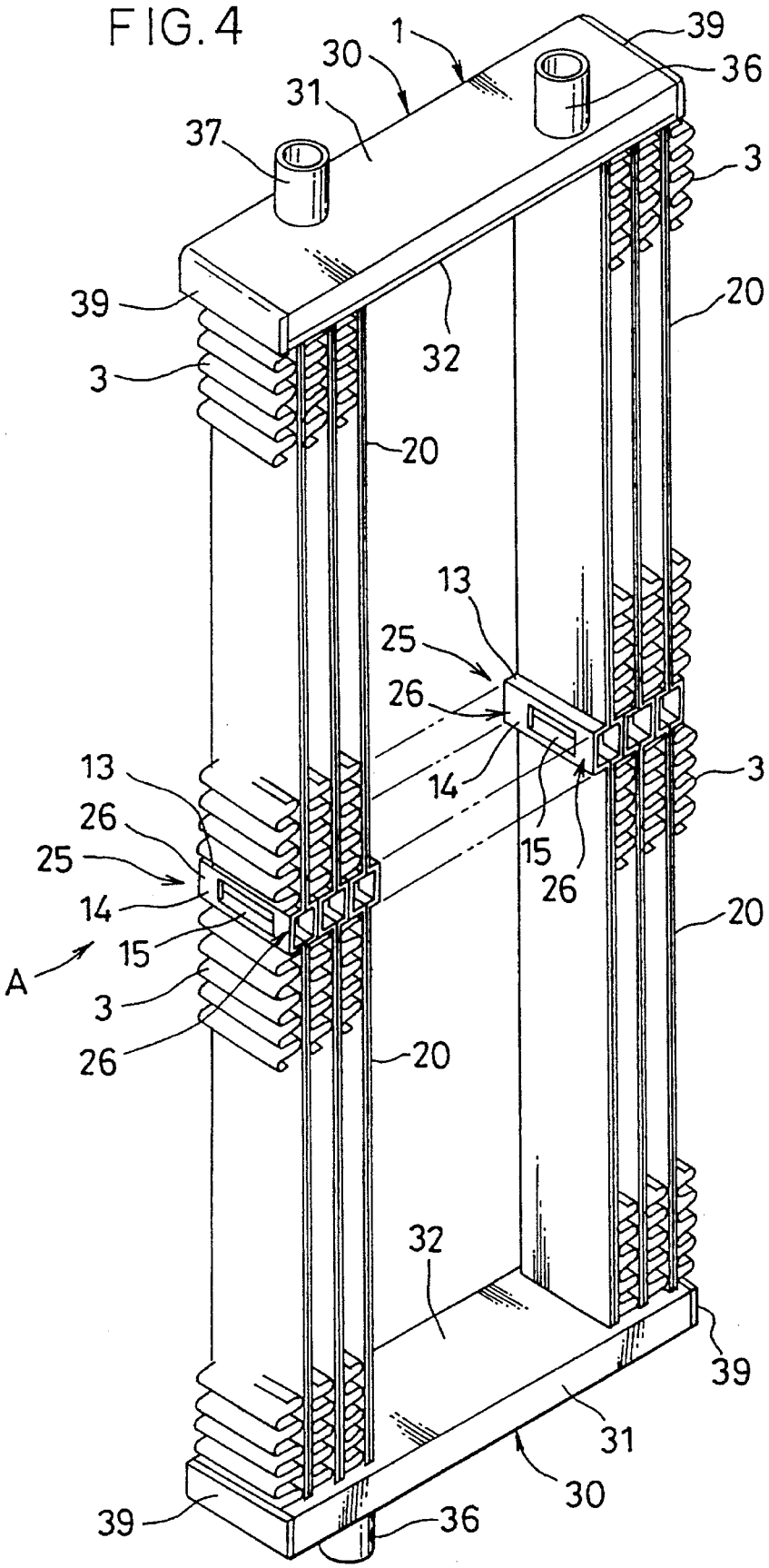
FIG. 4 is a perspective view illustrating the state that the tube element units and the tanks are assembled provisionally.

A tank 30 is, illustrated in FIGS. 3 and 4, constituted by a tank peripheral enclosure 31 whose cross section shows E-shaped by that a partition plate 33 stands in the longitudinal direction thereof, a flat shape end plate 32 which covers an opening side of the tank peripheral enclosure 31, covering plate 39 which cover on both sides of longitudinal direction of the tank peripheral enclosure 31. The tank 30 is constituted separately from the tube element unit 20A, the tank peripheral enclosure 31, the end plate 32 and covering plate 39 are made of aluminum alloy whose main ingredient is an aluminum claded solder material.

The tank 30 has a distributing passage 34 and a converging passage 35 divided by the partition plate 33, an intake pipe 36 of heat exchanging medium communicating to the distributing passage 34 and an outlet pipe 37 of it communicating to the converging passage 35.

The end plate 32 has a plurality of connecting holes 38, The connecting holes 38 being arranged by that a pair of connecting holes 38 which are put side by side are made to be laminated in the longitudinal direction thereof, the intake/outlet openings 21 and 22 of the tube element units 20A being inserted into and fixed on the connecting holes 38. By the intake/outlet openings 21 and 22 being inserted into and fixed on the connecting holes 38, the intake openings 21 are communicated with the distributing passage 34 and outlet openings 22 is communicated with the converging passage 35.

The following is an explanation of method of a heat exchanger using the tube element unit 20A and the tanks 30 constituted like the description in the above.

At first, as shown in FIG. 3, the intake/outlet openings 21 and 22 constituted in the both sides of the tube element units 20A are inserted into the connecting holes 38 of the end plate 32 of the tank 30 by putting corrugated fins 3 therebetween, a plurality of the tube element units 20A being laminated. Then, intake/outlet pipes 36 and 37 are connected to the tank 30, and an assembly 1 as shown in FIG. 4 is constituted.

In this case, by that intake/outlet openings 21 and 22 formed in the both sides of each tube element unit 20, thus each tube element unit 20A is in the state held by the tanks 30 arranged in the both sides thereof, the assembly is in the state of provisional maintenance. Therefore, even when the assembly 1 moves to be brazed in the furnace, tanks 30 positioning on the both sides of tube element units 20A can be used as replacement of holders used for provisional maintenance usually. Then, the assembly 1 is brazed in the furnace. Two heat exchangers are produced by that the cutting portion 26 is cut in the direction shown in an allow A by, for instance, a saw like a band saw, a slide-type dividing machine or an injection of water. Thus, the time necessary to produce by the above-mentioned method is cut down in comparison with the case of producing two heat exchanger respectively, being able to make producing process of the heat exchanger efficient.

Figure 5:
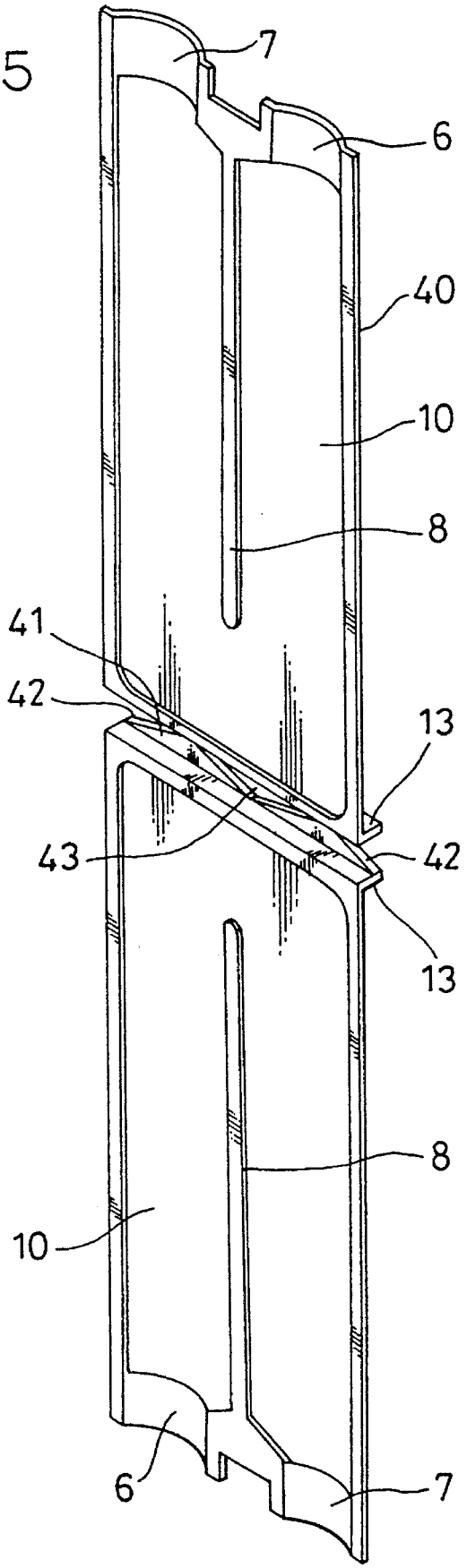
FIG. 5 is a perspective view illustrating a structure of a form plate for a hear exchanger in a second embodiment of this invention.

FIG. 5 shows additional embodiment of a form plate 40 used in the method of producing heat exchangers in this invention, the following is explanation of the form plate 40. Provided that the explanation is omitted by marking same reference numbers concerning the same constitution of the form plate 2, for instance, the bulging portion for intake/outlet formation 6 and 7, the bulging portion for passage formation 10, projection 8 and so on, explaining about different portions from the form plate 2 as the following. Furthermore, in the method of producing the heat exchangers, as the form plate 40 is made by the same process as the above-mentioned, the explanation about it is omitted.

The form plate 40 has fin contacting portions 13 extending to the outer, a cutting portion 41 connecting between the fin contacting portions 13 in the middle portion 5 thereof. Further, The fin contacting portion 13 is formed to hold one end of the corrugated fin 3, another end of the corrugated fin 3 being held on the end plate 32.

Figure 6:
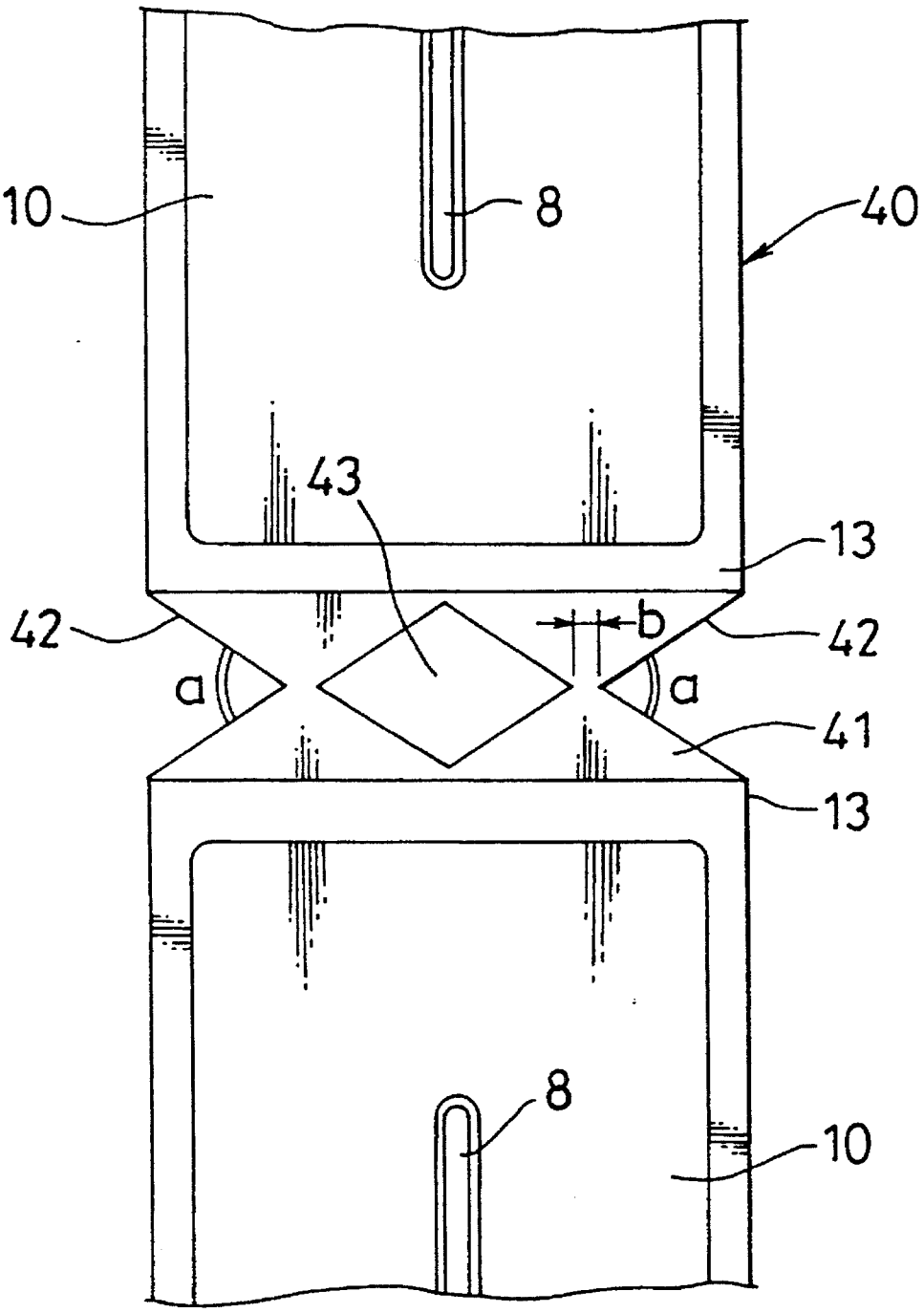
FIG. 6 is a view of expanding a portion of a cutting unit of a form plate illustrated in FIG. 5.

V-shaped cut portions 42 having a specific angle a shown in FIG. 6 are formed on the both sides of the cutting portion 41. This specific angle is determined within a range from 10 degrees to 45 degrees by considering a cutting work level and identification of a cutting position. A diamond-shaped opening 43 is formed between the V-shaped cut portions 42.

A measurement b between the opening 43 and the V-shaped cut portion 42 is determined approximately within a range from 0.5 mm to 1 mm by considering a strength necessary at the provisichal assembling and working level at cutting. Thickness of cutting portion 41 is determined about 1 mm by considering the strength necessary at the provisional assembling and the working level at cutting.

Figure 7:
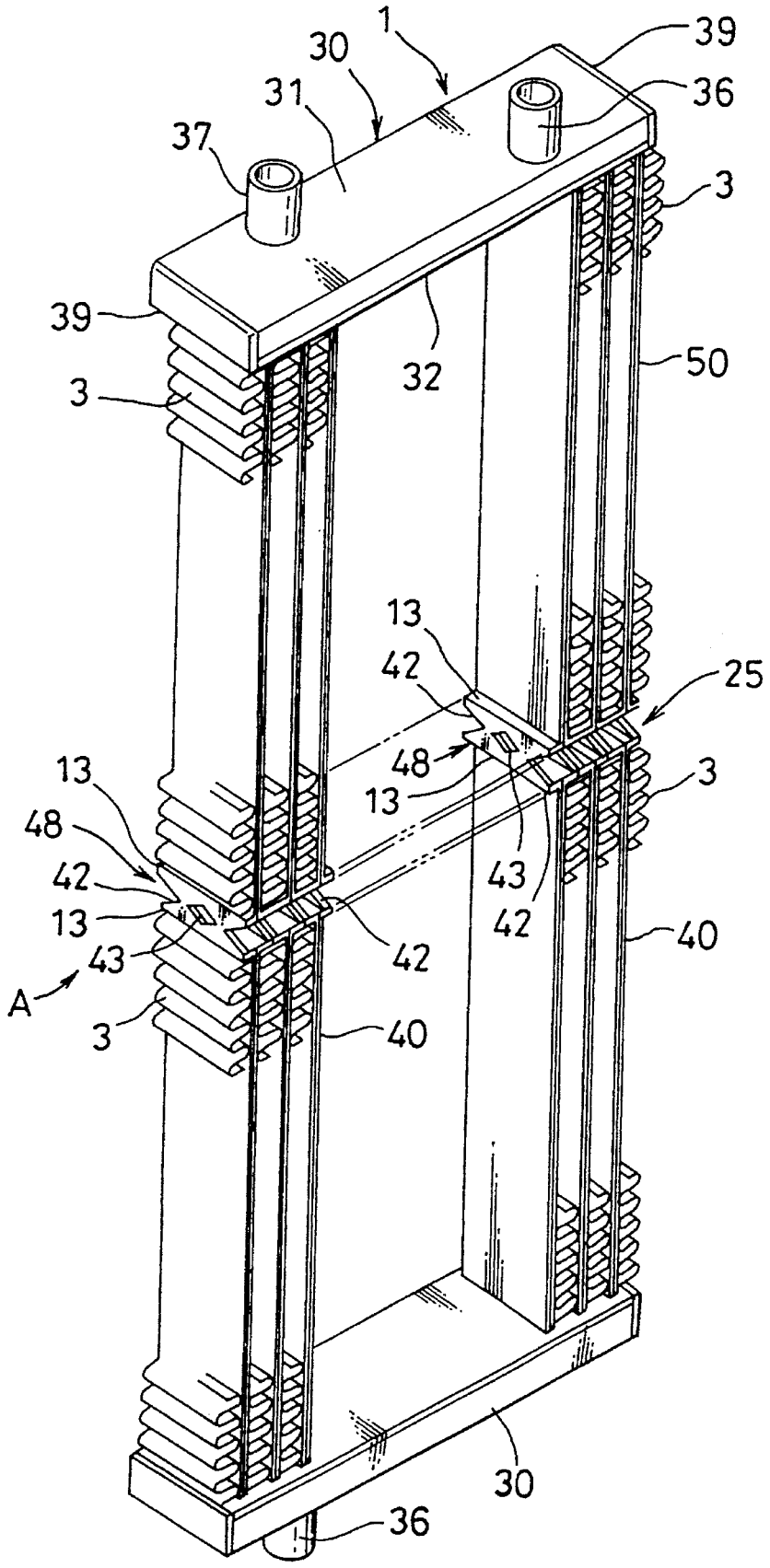
FIG. 7 is a perspective view illustrating the state that the tube element units which are constituted by bonding flush two of the form plates illustrated in FIG. 5.

A tube element unit 50A, which has the heat exchanging medium passages 24, intake/outlet portions 21 and 22, and the cutting portion 46 positioning in the middle portion 25, is constituted by bonding two form plates 40 flush to each other, the tube element units 50A being assembled to tanks 30 while putting fins therebetween, thus, an assembly as shown in FIG. 7 is constituted. Two heat exchangers are separated by that the cutting portions 48 of the assembly 1 are cut by a saw like a band saw, injection of water or the like. Further, as the cutting portion 48 has cut portion 42 and opening 43, two heat exchangers can be separated by urging a bending force to the cutting portion 48, or it is possible to separate by urging pulling force to the cutting portion 48.

Figures 8A, 8B:
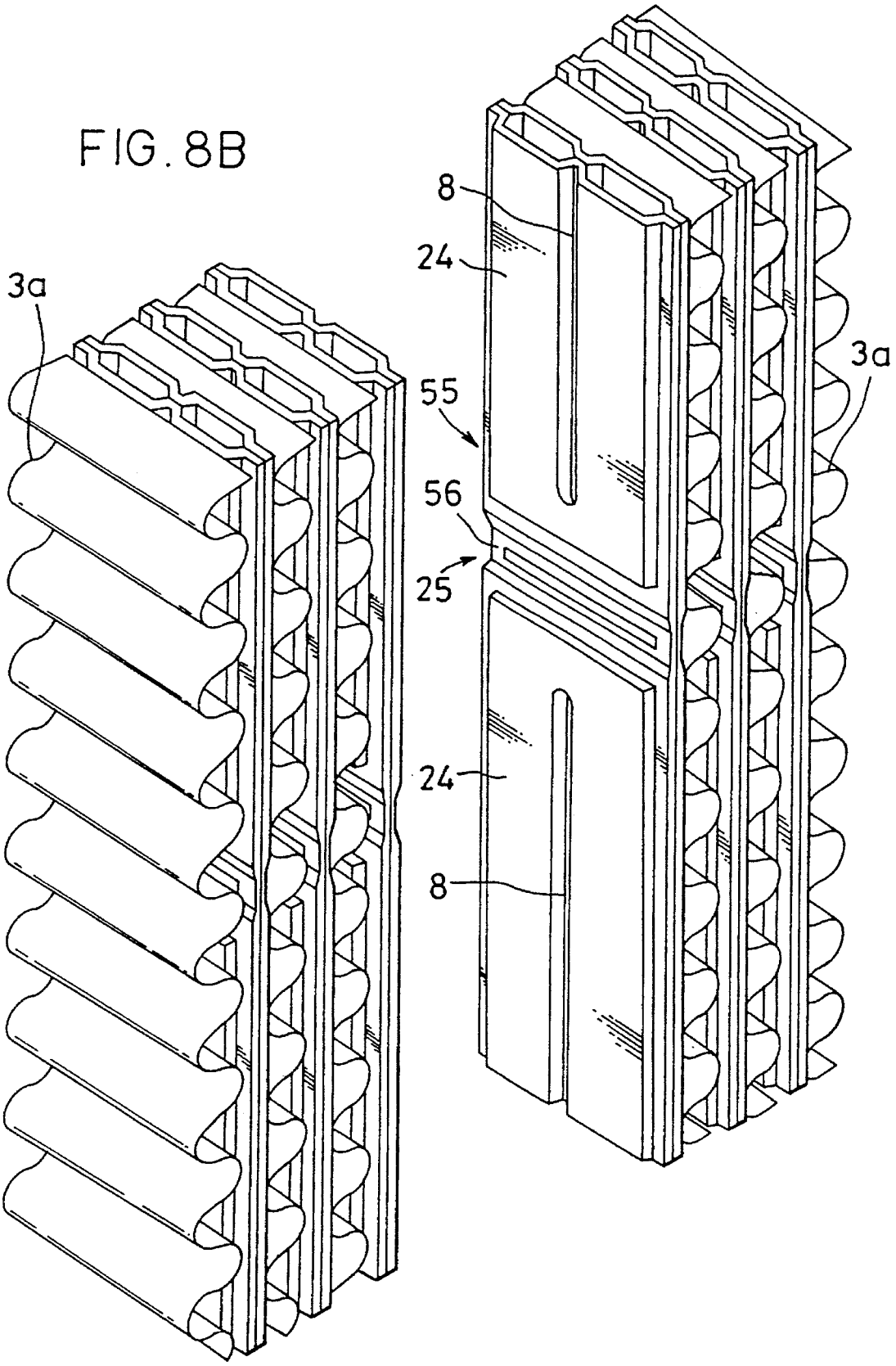
FIGS. 8A and 8*b* are perspective views expanding partly illustrating a portion adjacent to a cutting unit for a heat exchanger in a third embodiment of this invention.

FIGS. 8A and 8B show a third embodiment due to a tube element unit 55A different from the tube element units 20A and 50A and fins 3*a* different from the aforementioned fins 3, the following is an explanation regarding the tube element unit 55A and the fins 3*a*.

Regarding the same construction as aforementioned tube element unit in the tube element unit 55, that is, the heat exchanging medium passage 24 and the projection 8, the explanation of them is omitted by marking the same reference number, the following is an explanation of different portions.

The fin contacting portion like the aforementioned in the middle portion 25 between the heat exchanging medium passages 24 thereof is not formed in the tube element unit 55A, but the tube element unit 55A has a cutting portion 56 formed thinner than thickness of a form plate to constitute the tube element unit 55A and in the shape of a plate. Thus, surface of the tube element unit 55A in the laminating direction are approximately flat. Measurement of the fin 3*a* is, not appeared in the figures, approximately equal to longitudinal measurement of the tube element unit 55A.

In aforementioned embodiments, when the tube element units 20A or 50A are laminated by putting fins 3 therebetween, as space between the tube element units respectively is divided into two parts, two fins are needed to put between tube elements units. In this embodiment, as space between the tube element units respectively has one fin 3*a*, work to assemble the heat exchangers is made easier.

As the above-mentioned, due to the method of the heat exchangers according to this invention, the intake/outlet portions formed on the both sides in the longitudinal direction of the tube element units are connected with the connecting holes of the tanks, thus, a plurality of the laminated tube element units are held by the tanks arranged on the both sides thereof. Therefore, only assembling the tube element units to the tanks provisionally, the assembly being state of provisional maintenance, the holders becoming useless, treatment of the assembly is convenient, and separation of the assembly is performed easily without increasing a number of parts.

Figure 9:
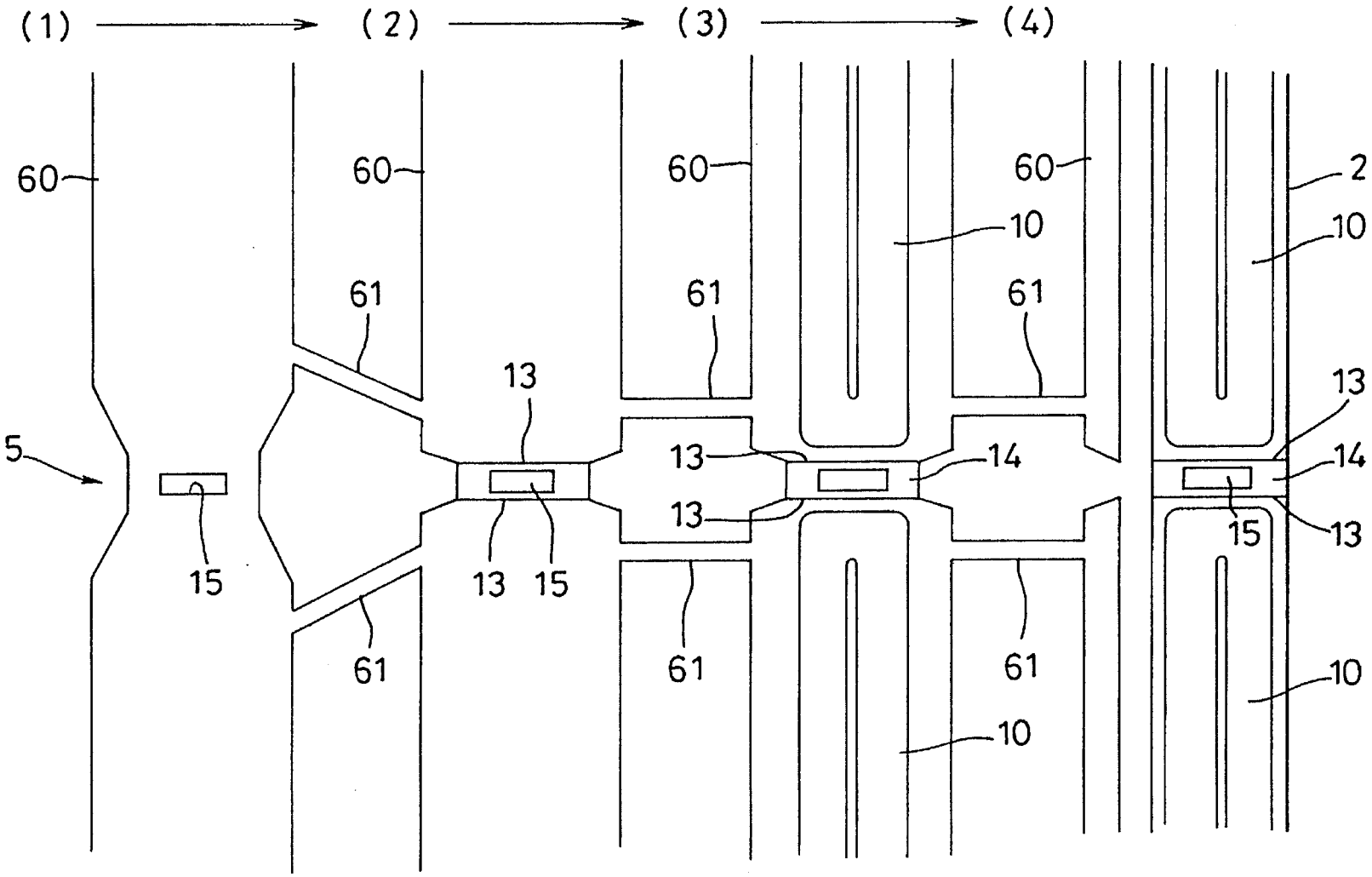
FIG. 9 is a explanation view illustrating process of pressing the form plates illustrated in FIG. 1.

What is called a pass-on method, as illustrated in FIG. 9, is used for producing the form plate, the method is that a plurality of plates 60 connected by connecting portions 61 mutually are moved in due order to the direction of the allow illustrated in FIG. 9 whenever one process is completed.

An embodiment of the method is explained along processes for the producing the form plate 2 shown in FIG. 1.

In a first process shown in FIG. 9 (1), the opening 16 is punched by the press in the middle portion 5 of a flat plate 60, which is sent to a second process.

In the second process shown in FIG. 9 (2), the middle portion 5 is pressed out by the press to form the fin contacting portions 13 and 13 on both sides of the middle portion 5.

In a third process shown in FIG. 9 (3), the bulging portions for passage formation 10, bulging portions for intake/outlet formation 6 and 7 are pressed out and other portions are formed.

In a fourth process shown in FIG. 9 (4), the connecting portions 61 and the remainder of the plate 60 are cut down, thus, producing of the form plate 2 is completed.

However, this invention provides a form plate having shapes of fin contacting portions being able to be formed in state of keeping its longitudinal measurement during forming it, and to hold the fins surely, the following is an explanation of it.

Figure 10:
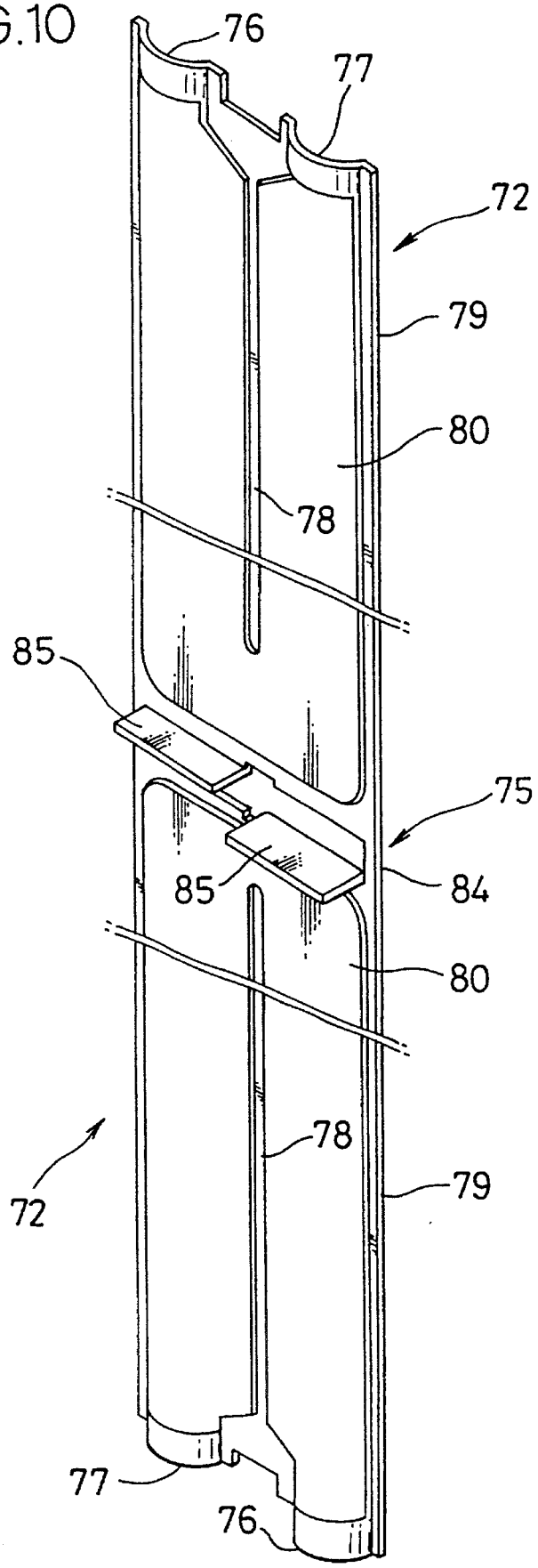
FIG. 10 is a perspective view illustrating a structure of a form plate in a fourth embodiment of this invention.

A form plate 72 as illustrated in FIG. 10 is made of aluminum alloy whose main material is an aluminum, and solder is claded on the both sides thereof, similar to the form plate 2 shown in FIG. 1, which is a long and narrow rectangle to be used for producing a tube element of a heat exchanger. Bulging portions for passage formation 80 and bulging portions for intake/outlet formation 76 and 77 communicated with the bulging portion for passage formation 80 are pressed out, for instance, by press on the both sides of cutting portion 84.

In the form plate 72, a projection 78 is extended from between the bulging portions for intake/outlet formation 76 and 77, the bulging portion for passage formation 80 communicated with the bulging portions for intake/outlet formation 76 and 77 is formed around the projection 78. Brazing portion 79 is formed along the fringe of the bulging portions for passage formation 80 and the bulging portions for intake/outlet formation 76 and 77.

Fin contacting portions 85 are formed in a middle portion 75 at the center of longitudinal direction of the form plate 72. The middle portion 75 of the form plate 72 has a pair of fin contacting portions 85 arranged side by side in the lateral direction of the form plate 72, one fin contacting portion 85 extending from one specific portion of the form plate 72 as an end of one tube element 90 and bending up to a bulging direction of the form plate 72, another fin contacting portion 85 extending from another specific portion of the form plate 72 as an end of another tube element 90 and bending up to the bulging direction.

In other words, the fin contacting portions 85 are arranged side by side in the lateral direction of the from plate 72, and cutting portions 84 are formed on the outer sides of the fin contacting portions 85. The fin contacting portions 85 are cut in three sides thereof alternately and raised up to the bulging direction.

Figure 11:
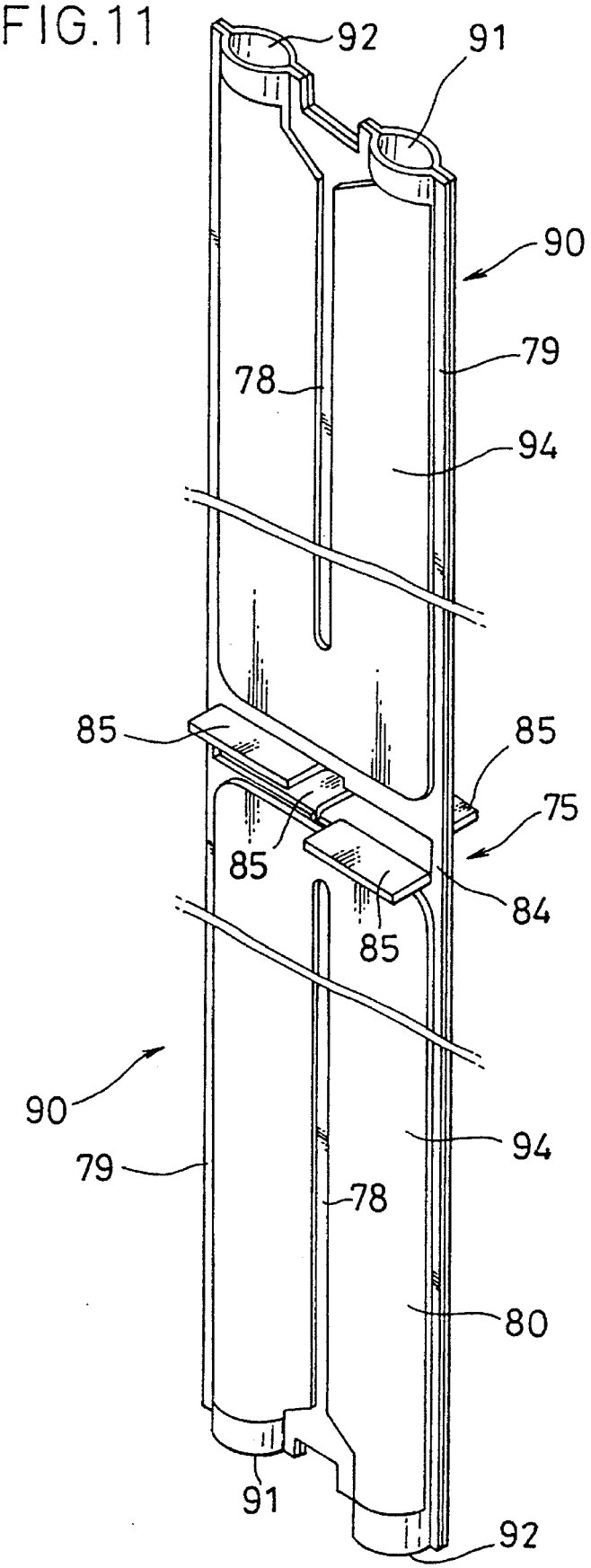
FIG. 11 is a perspective view illustrating a tube element unit comprising a pair of tube elements constituted by bonding flush two of the form plates illustrated in FIG. 10.

A tube element unit 90A is constituted by bonding two form plates 72 flush to each other, as shown in FIG. 11. Thus, intake/outlet portions 91 and 92 are constituted by the bulging portions for intake/outlet formation 76 and 77 facing each other, medium passages 94 are constituted by the bulging portions for passage formation 80 facing each other, and the tube element unit 90A having them is constituted symmetrically with respect to the middle portion 75.

Figure 12:
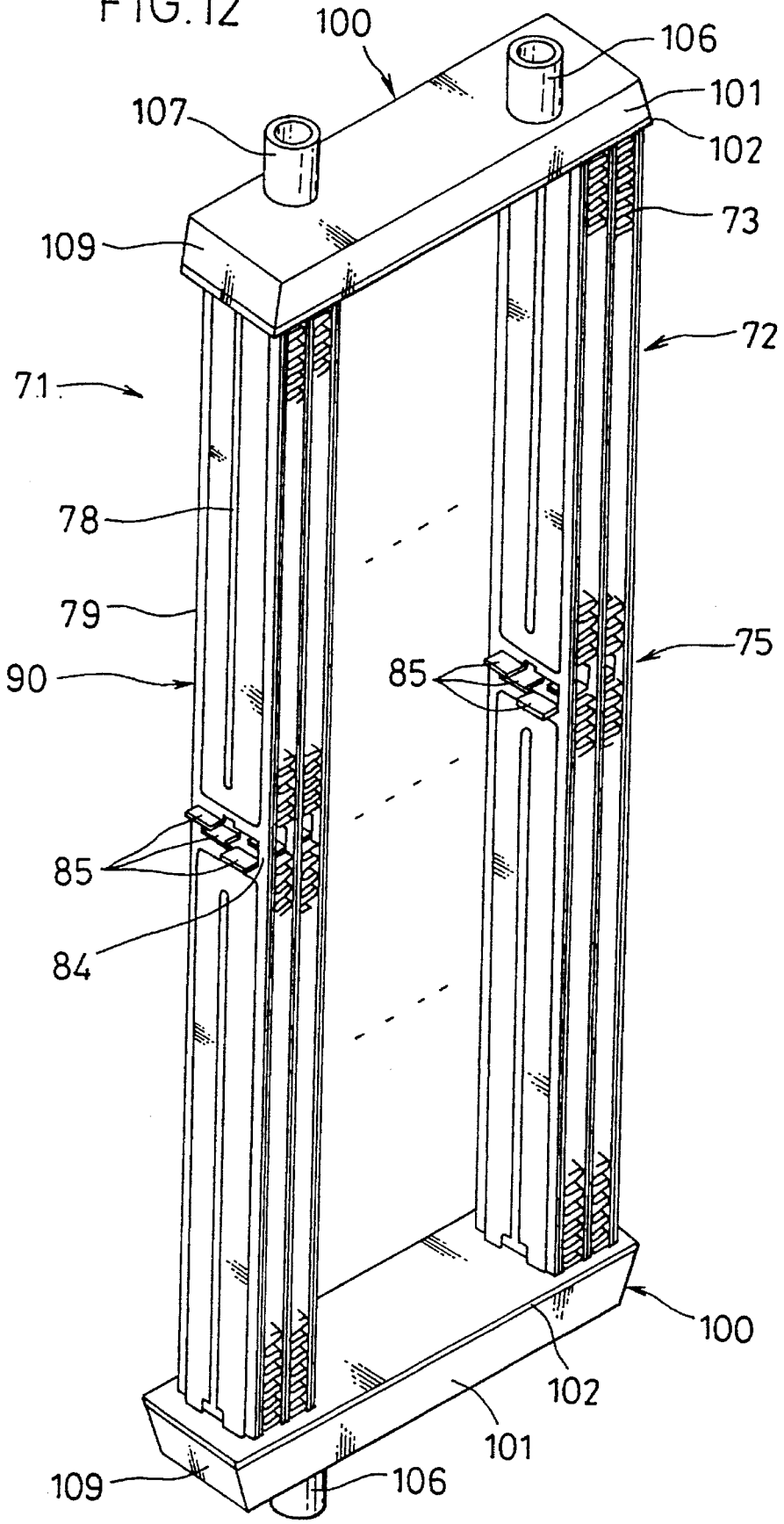
FIG. 12 is a perspective view illustrating the state that the tube element units illustrated in FIG. 11 and the tanks are assembled provisionally.
Figure 13:
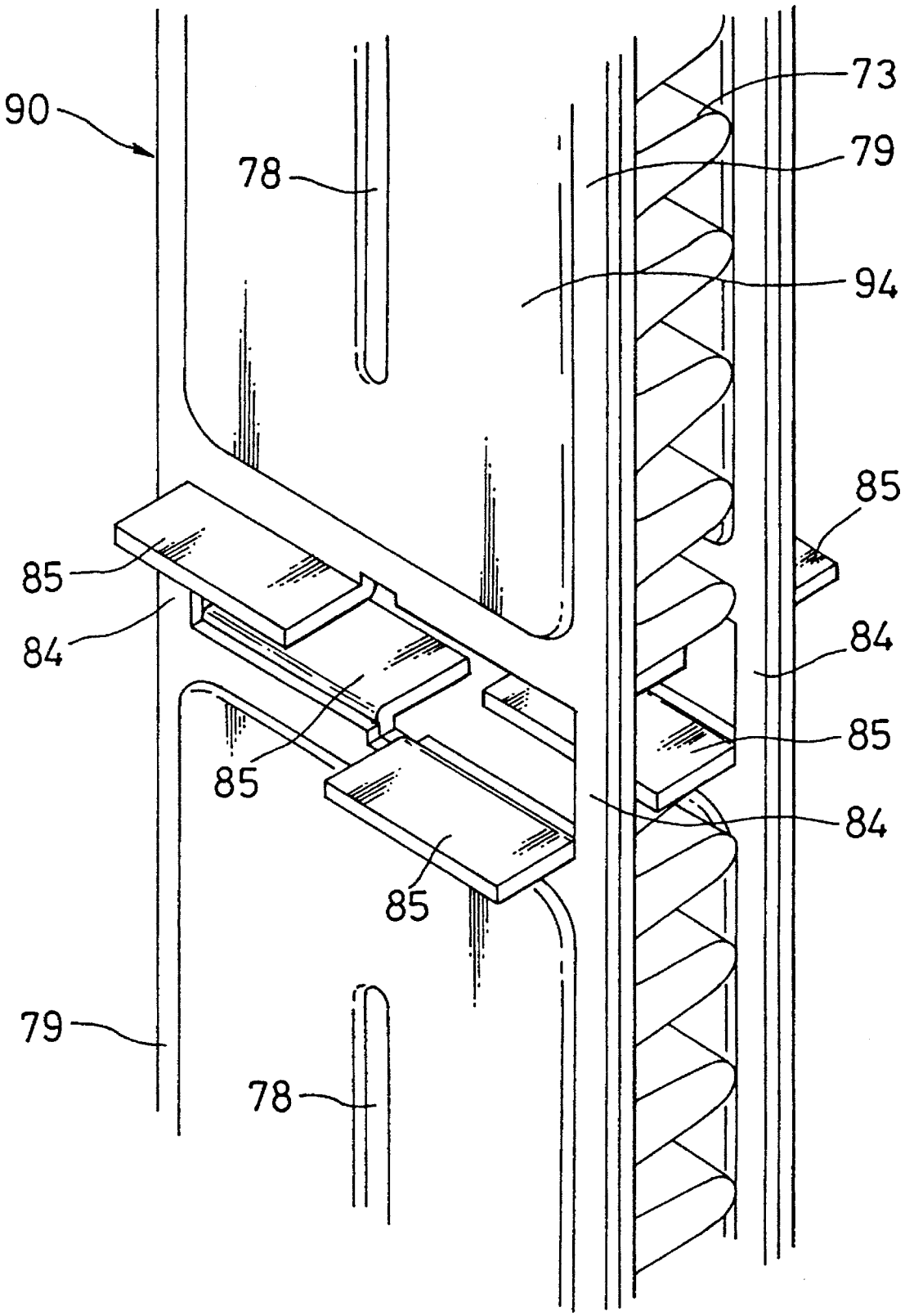
FIG. 13 is a perspective view expanding partly illustrating the tube element units assembled provisionally, illustrated in FIG. 12.

As shown in FIGS. 12 and 13, when the tube element units 90A are laminated with inserting fins 73 therebetween, the fin contacting portions 85 of the adjacent tube element units 90A extend to between the adjacent tube element units 90A alternately without touching each other, and the fin contacting portions 85 arranged alternately between the adjacent tube element units 90A are overlapped against wind blow direction into the heat exchanger.

Figure 14:
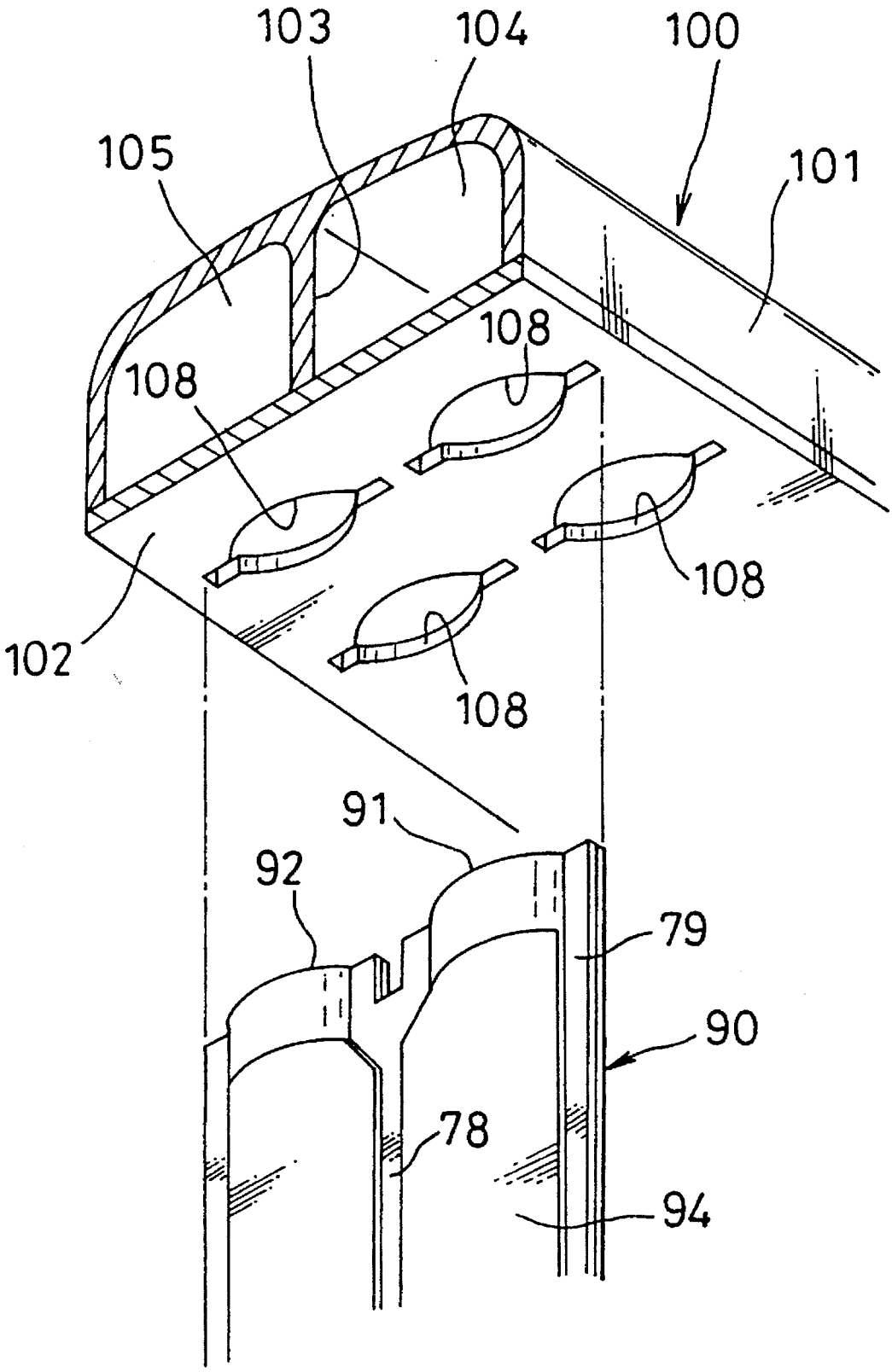
FIG. 14 is a part perspective view illustrating the state that the tube elements shown in FIG. 12 are inserted into connecting holes of a tank.

A tank 100 where the tube element units 90A are connected comprises, as shown in FIGS. 12 and 14, a tank peripheral enclosure 101 whose section view is E-shaped by standing a partition plate 103 in longitudinal direction, an end plate 102 which is a flat plate and covering with opening side of the tank peripheral enclosure 101, and covering plates 109 covering the both sides, of the longitudinal direction of the tank peripheral enclosure 101, the tank 100 is constituted separately from the tube element unit 90A, the tank peripheral enclosure 101, the end plate 102 and covering plates 109 are made of aluminum alloy whose main material is aluminum, solder being claded of the both sides thereof.

The tank 100 has a distributing passage 104 and a converging passage 105 divided by the partition plate 103, an intake pipe 106 of heat exchanging medium is connected to the distributing passage 104, and an outlet pipe 107 of it is connected to the converging passage 105.

A pair of connecting poles 108 where the intake/outlet portions 91 and 92 of a tube element 90 inserting are formed plurally in the longitudinal direction. By that the intake/outlet portions 91 and 92 insert into and fix in the connecting holes 108, the intake portion 91 is communicated to the distributing passage 104 of the tank 100 and the outlet portion 92 is communicated to the converging passage 105 of the tank 100.

Figure 15:
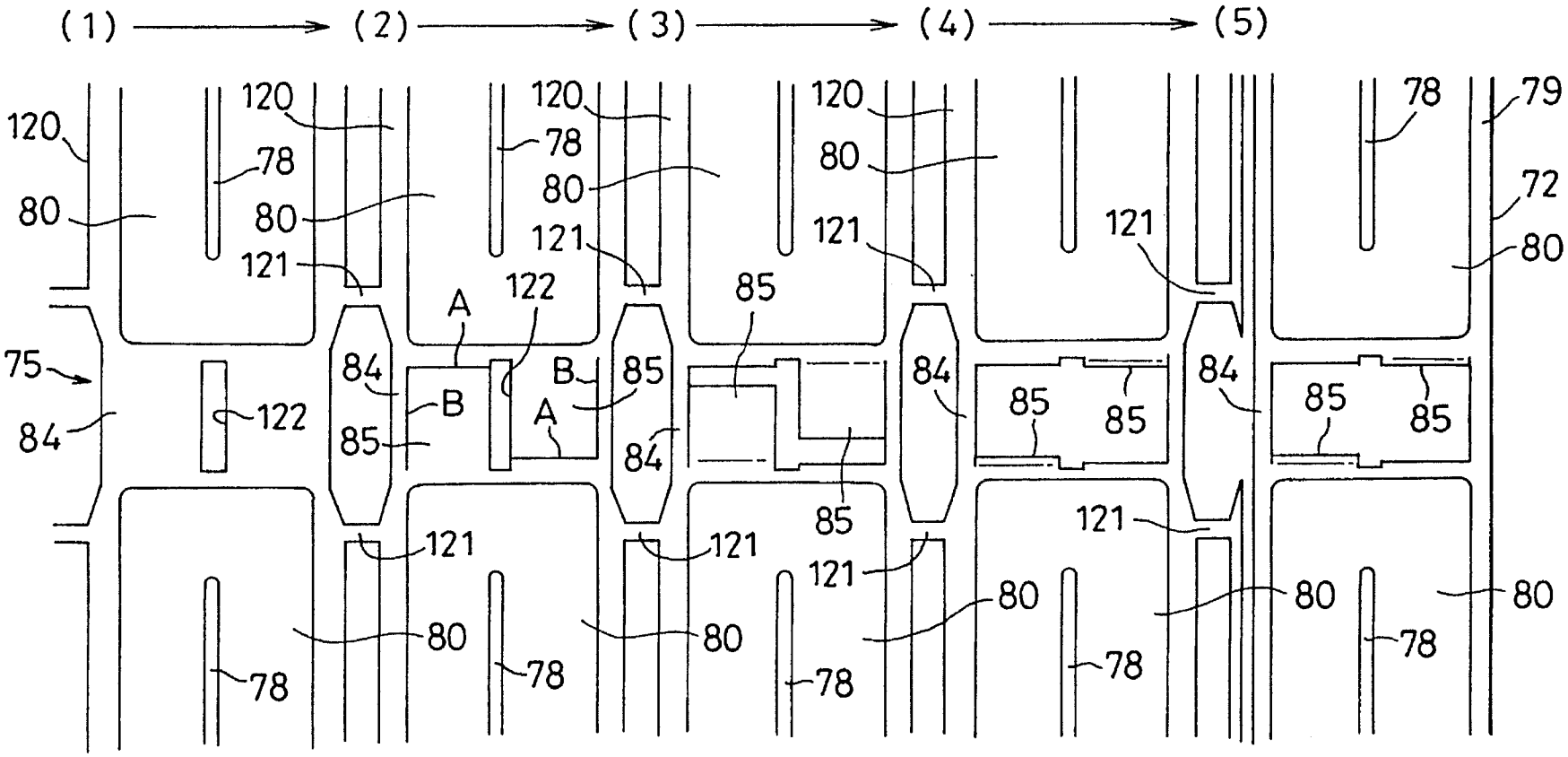
FIG. 15 is a explanation view illustrating process of pressing the form plates illustrated in FIG. 12.

The form plate 72 is constituted by what is called a pass-on method which is that a plurality of plates 120 connected by connecting portions 121 mutually are moved in due order to the direction of the allow illustrated in FIG. 15 whenever one process is completed.

The processes for the producing is explained in order as follows.

Pre-formed plate 120 on which the bulging portions for passage formation 80, the projection 78 and so on have already been formed by the press is sent to a first process. In the first process shown in FIG. 15 (1), a rectangular hole 122 long in the perpendicular direction to the pass-on direction, that is in a longitudinal direction of the form plate, is formed in the middle portion 75 to make it easy to make following cuts A.

In a second process shown in FIG. 15 (2), cuts A are made to the lateral direction from each point adjacent to both ends of the longitudinal direction symmetrically, cuts B are made to the perpendicular direction against the cuts A from each outer point of the cuts A. The measurement of the cut B is set more than half distance between the middle portions 75 of the adjacent tube element units 90A when the tube element units 90A are laminated, and measurement of the cut A is set about hale of the lateral direction of the tube element unit 90A or less than half of it.

In a third process shown in FIG. 15 (3), the fin contacting portions 85 are bent at an angle of 60° provisionally by making the rest side a bending line, and then, in a fourth process shown in FIG. 15 (4), the fin contacting portions 85 are bent to a angle of 90° further. Thus, the fin contacting portions 85 standing perpendicularly to the plate 120 are formed.

At last, in a fifth process shown in FIG. 15 (5), by that connecting portion 121 and the remainder around the plate 120 are cut down, and producing the form plate 72 is completed.

Furthermore, after the first process, fin contacting portions 85 can be cut and bent directly by combining the third and fourth processes, and in this case the second process can be omitted.

An assembly 71 of heat exchangers as shown in FIG. 12 is constituted by that the intake/outlet portions 91 and 92 are inserted into and fixed in the connecting holes 108 of the tanks 100 arranged on the both sides of tube element units 90A, and that the tube element units 90A are laminated with putting fins 73 therebetween. In the assembly 71, the fins 73 between the tube element units 90A are held by the fin contacting portions 85, as shown in FIG. 13. Then, after brazing the assembly 71 of the heat exchangers in the furnace, two heat exchangers can be produced simultaneously by cutting the cutting portion 84 and separating two.

Figure 16:
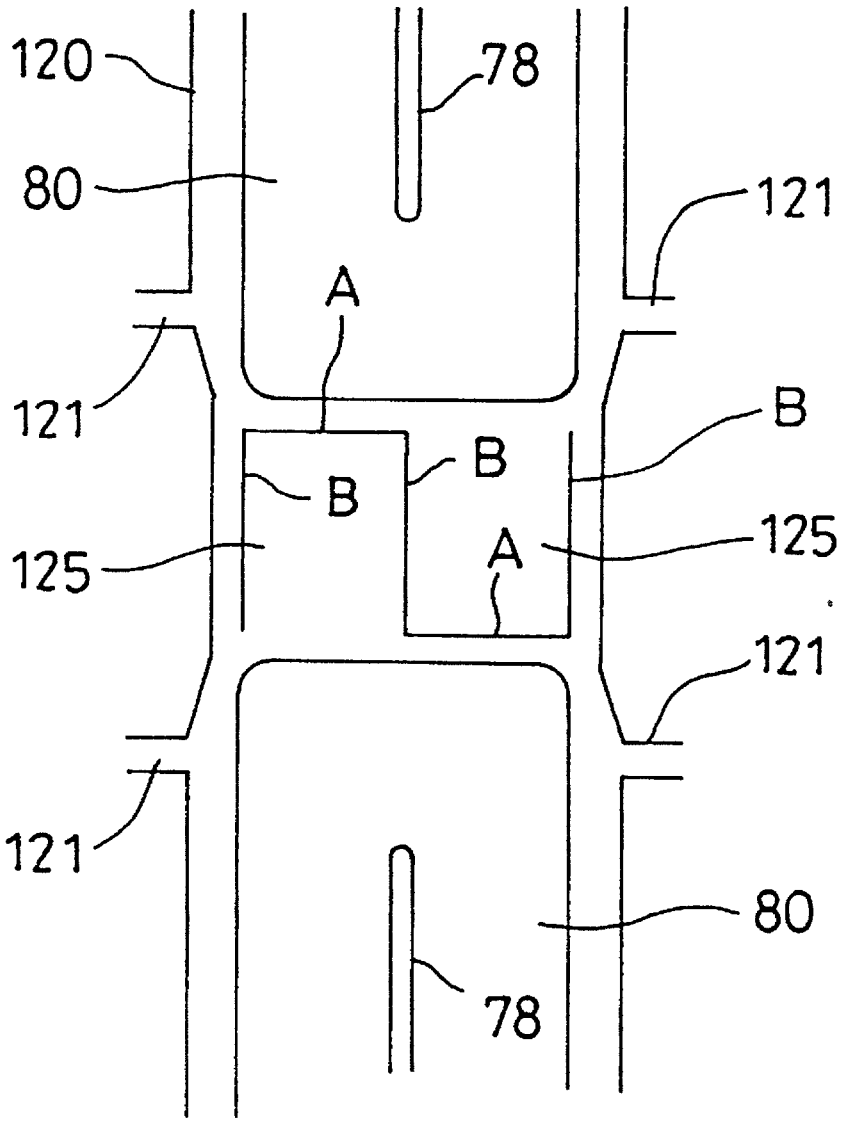
FIG. 16 is a explanation view illustrating another process of pressing the form plates illustrated in FIG. 12.

The hole 122 is formed in the middle portion 75 in the first process shown in FIG. 15 (1) in the aforementioned embodiment. However, for instance, as shown in FIG. 16, in a first process, three cut B extending to the longitudinal direction of the tube element unit 72 are made in the center and adjacent sides of the middle portion 125, and one cut A connecting one end of the middle cut B and one end of the side cut B and another cut A connecting another end of the middle cut B and one end of the another side cut B are made at the same time, then, performing the fourth and fifth process, thus a pair of fin contacting portions 125 are formed. The fin contacting portions 125 formed by thus is enlarged width of themselves and enlarged a portion contacting to the fins 73 to hold fins 73 surely, and decreasing work of forming the hole 122 and preventing yielding scraps because the holes 122 are not made and it is not necessary to tidy the scraps. Because structure of the form plate 72 having the fin contacting portions 125 is same as the aforementioned embodiment excluding the fin contacting portions 125, an explanation is omitted by marking the same reference number in the same parts.

In the aforementioned embodiments, the fin contacting portions 85 and 125 are explained as what are formed on the form plate of the tube element unit, however, it is not necessary to be defined in thus constitution, therefore they may be formed a form plate used for producing two heat exchangers in which tanks are united with tube element units simultaneously.

as the above, as the fin contacting portions are formed by bending up to the same direction as the bulging direction of the bulging portion for passage formation according to the aforementioned form plate of the heat exchanger, it is avoided to pull a plate into the middle portion, preventing deformation of the connecting portion connecting between plates in the processes for producing the form plate.

According to the form plate of the heat exchanger, since the fin contacting portions is more than half of distance between the middle portions of adjacent tube element units, the fin contacting portions of adjacent tube element units are overlapped in the wind pass direction of the heat exchanger, preventing fins from inserting into the gap between the fin contacting portions.

What is claimed is:

1. A method of producing heat exchangers that each comprise a tank having an end plate with a plurality of connecting holes in the end plate arranged in parallel in a laminating direction, tube elements each having a pair of intake and outlet portions located in the connecting holes and a U-shaped heat exchanging medium passage connecting the intake and outlet portions, and fins located between the tube elements, said method comprising the steps of:

(a) forming a plurality of form plates so that each form plate extends in a longitudinal direction, has a middle portion, has a pair of first bulging portions formed on both ends thereof in the longitudinal direction, each pair of first bulging portions forming intake and outlet formations for forming the intake and outlet portions, has projections extending from between the first bulging portions toward the middle portion, has second bulging portions formed around each of the projections for the formation of a passage, and has a cutting unit having a cutting portion formed in said middle portion;

(b) bonding flush pairs of the form plates to form tube element units that each comprises a pair of the tube elements, the pair of the tube elements being joined at the cutting unit having the cutting portion, and the intake and outlet portions being formed on the tube elements thereby;

(c) forming a provisional assembly of two heat exchangers by inserting the intake and outlet portions formed on both ends of the tube element units into connecting holes of tanks disposed at both ends of the tube element units and putting corrugated fins between the tube elements of the tube element units;

(d) brazing the provisional assembly in a furnace; and (e) cutting the cutting portion so as to separate the assembly and form two separate heat exchangers.

2. The method of producing the heat exchanger according to claim 1, wherein:

the cutting portion of each form plate is a flat plate pressed out as a convex from the form plate.

3. The method of producing the heat exchanger according to claim 2, wherein:

the cutting portion of each form plate has a rectangular opening formed therein.

4. The method of producing the heat exchanger according to claim 1, wherein:

the cutting portion of each form plate has V-shaped cut portions cut at a specific angle on both sides thereof.

5. The method of producing the heat exchanger according to claim 2, wherein:

the cutting portion of each form plate has V-shaped cut portions cut at a specific angle on both sides thereof.

6. The method of producing the heat exchanger according to claim 4, wherein:

the specific angle of the V-shaped cut portions is within a range of 10 degrees to 45 degrees.

7. The method of producing the heat exchanger according to claim 5, wherein:

the specific angle of the V-shaped cut portions is within a range of from 10 degrees to 45 degrees.

8. The method of producing the heat exchanger according to claim 4, wherein:

the cutting portion of each form plate has a diamond-shaped opening between the v-shaped cut portions.

9. The method of producing the heat exchanger according to claim 5, wherein:

the cutting portion of each form plate has a diamond-shaped opening between the V-shaped cut portions.

10. The method of producing the heat exchanger according to claim 6, wherein:

the cutting portion of each form plate has a diamond-shaped opening between the V-shaped cut portion.

11. The method of producing the heat exchanger according to claim 7, wherein:

the cutting portion of each form plate has a diamond-shaped opening between the V-shaped cut portions.

12. The method of producing the heat exchanger according to claim 1, wherein:

the cutting portion of each form plate is formed by the thickness of the middle portion of the form plate being made thinner than other portions of the form plate.

13. The method of producing the heat exchanger according to claim 12, wherein:

the cutting portion has a rectangular opening therein.

14. The method of producing the heat exchanger according to claim 1, wherein:

the middle portion of each form plate has a pair of fin contacting portions arranged side by side in a lateral direction of the form plate, one fin contacting portion extending from one specific portion of the form plate as an end of one tube element bent in a bulging direction of the form plate, and another fin contacting portion extending form another specific portion of the form plate as an end of another tube element bent in the bulging direction.

15. The method of producing the heat exchanger according to claim 14, wherein:

the length of the fin contacting portion that is bent is more than half of the distance between the middle portions of adjacent tube element units.

* * * * *